US012416215B2

(12) United States Patent
Freire de Souza Sobrinho et al.

(10) Patent No.: US 12,416,215 B2
(45) Date of Patent: Sep. 16, 2025

(54) DOWNHOLE PACKER SUITABLE FOR SMART WELL COMPLETION

(71) Applicant: Petróleo Brasileiro S.A.—Petrobras, Rio de Janeiro (BR)

(72) Inventors: Raul Freire de Souza Sobrinho, Mossoró (BR); Edson Henrique Bolonhini, Natal (BR); Carlos Francisco Sales de Souza, Natal (BR); Manuel Savio Silveira Santos, Mossoró (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 0 days.

(21) Appl. No.: 17/780,763

(22) PCT Filed: Nov. 19, 2020

(86) PCT No.: PCT/BR2020/050489
§ 371 (c)(1),
(2) Date: May 27, 2022

(87) PCT Pub. No.: WO2021/102543
PCT Pub. Date: Jun. 3, 2021

(65) Prior Publication Data

US 2022/0412184 A1 Dec. 29, 2022

(30) Foreign Application Priority Data

Nov. 28, 2019 (BR) ..... 10 2019 025233 2

(51) Int. Cl.
*E21B 33/12* (2006.01)
*E21B 17/02* (2006.01)
*E21B 47/12* (2012.01)

(52) U.S. Cl.
CPC ..... *E21B 33/12* (2013.01); *E21B 17/025* (2013.01); *E21B 47/12* (2013.01); *E21B 17/023* (2013.01); *E21B 17/026* (2013.01)

(58) Field of Classification Search
CPC .... E21B 17/023; E21B 17/025; E21B 17/026; E21B 33/12; E21B 47/12
See application file for complete search history.

(56) References Cited

U.S. PATENT DOCUMENTS 4,798,243 A 1/1989 Curington et al.
5,875,852 A 3/1999 Floyd et al.
(Continued)

FOREIGN PATENT DOCUMENTS

BR PI1001485 A2 1/2012
WO 2007008481 A1 1/2007

*Primary Examiner* — Tara Schimpf
*Assistant Examiner* — Lamia Quaim
(74) *Attorney, Agent, or Firm* — Morrison & Foerster LLP

(57) ABSTRACT

An upper connector, a lower connector, and an inner tube, adapted to allow the passage of hydraulic control lines and/or electrical cables internally to a packer mandrel, are installed without interference with the passage of tools or flow. The conventional packer is transformed by allowing control from the surface. Hydraulic equipment (sliding sleeve valves) or transmitting/receiving data from flow rate, pressure and temperature sensors (PDG—Permanent Downhole Gauge) are positioned in the production or injection string (30) below the packer. The packer includes an upper adapter, an lower adapter, and an inner tube, through which control lines or electrical cables internally pass.

5 Claims, 10 Drawing Sheets

(56) References Cited

U.S. PATENT DOCUMENTS

| | | | | |
|---|---|---|---|---|
| 6,325,144 | B1 | 12/2001 | Turley et al. | |
| 9,885,233 | B2 * | 2/2018 | Wayne | E21B 33/1243 |
| 2002/0074116 | A1 | 6/2002 | Millar et al. | |
| 2005/0001736 | A1 * | 1/2005 | Hall | E21B 17/023 340/855.1 |
| 2009/0205832 | A1 * | 8/2009 | Jean-Luc | E21B 34/106 166/73 |
| 2009/0250228 | A1 | 10/2009 | Loretz et al. | |
| 2015/0354315 | A1 * | 12/2015 | Windegaard | E21B 33/1293 166/183 |
| 2018/0148997 | A1 * | 5/2018 | Goodman | E21B 33/1208 |

* cited by examiner

DOWNHOLE PACKER SUITABLE FOR SMART WELL COMPLETION

CROSS-REFERENCE TO RELATED APPLICATIONS

This application is a national phase application, filed under 35 U.S.C. § 371, of PCT International Patent Application No. PCT/BR2020/050489, filed Nov. 19, 2020, and claims benefit of and priority to Brazilian application BR 10 2019 025233 2, filed on Nov. 28, 2019, the disclosures of all of which are incorporated herein by reference in their entirety.

FIELD OF INVENTION

The present invention addresses to an improvement in a conventional packer comprising an upper adapter, a lower adapter and an inner tube specially adapted to allow the passage of hydraulic control lines or electrical cables or optical cables through the packer, without interfering in the passage of tools or in the flow through the production or injection string. The conventional packer according to the present invention is turned into a feedthrough packer. This ability allows the use of conventional packers in strings sized for use in smart completion of oil wells.

DESCRIPTION OF THE STATE OF THE ART

The special packers (feedthrough packer) used in smart completion have the same components as conventional packers for oil wells, such as anchor wedges, mandrel, sealing elements, drag blocks, etc. However, there is a fundamental difference in relation to conventional packers: the presence of channels that traverse the equipment, allowing the control and monitoring of equipment that are below the packer by means of hydraulic tubes or electrical lines. They are applied in wells for smart completion and have a high cost as the project already includes these special passages. No document of the state of the art comprises this solution for adapting conventional packers for use as smart completion packers.

BRIEF DESCRIPTION OF THE INVENTION

The present invention addresses to adapters with passage channels that are installed at the ends of a conventional packer together with an inner tube inserted internally into the mandrel creating an eccentric circular annular space between this inner tube and the mandrel, thus enabling the passage of hydraulic lines or communication cables, also enabling a conventional packer for smart completion. The cost of this adaptation is lower, when compared with purchasing special packers, because it allows the use of a group of conventional packers without the need to purchase equipment whose use is very particular and specific.

BRIEF DESCRIPTION OF DRAWINGS

The present invention will be described in more detail below, with reference to the attached figures which, in a schematic form and not limiting the inventive scope, represent examples of its embodiment. In the drawings, there are.

DETAILED DESCRIPTION OF THE INVENTION

Figure 1:
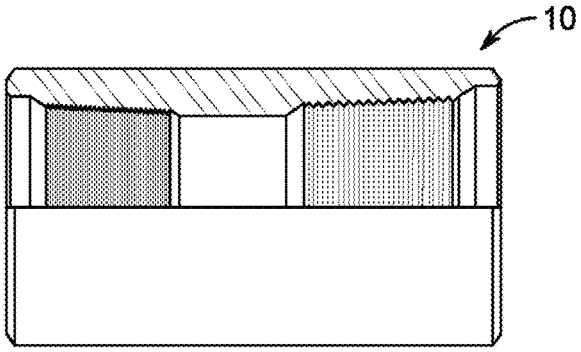
(Prior Art) FIG. 1
FIG. 1 illustrating an upper connection of a conventional packer of the state of the art.
Figure 2:
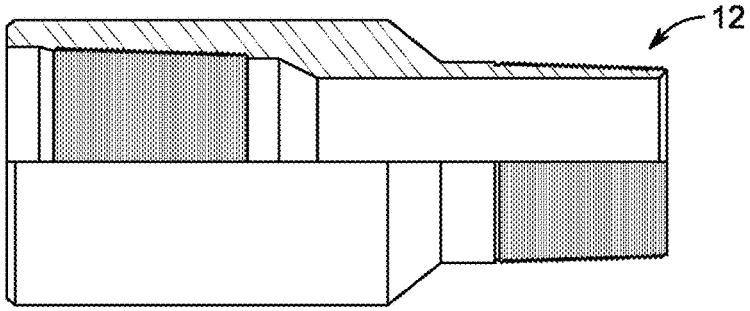
(Prior Art) FIG. 2
FIG. 2 illustrating a lower connection of a conventional packer of the state of the art.
Figure 11:
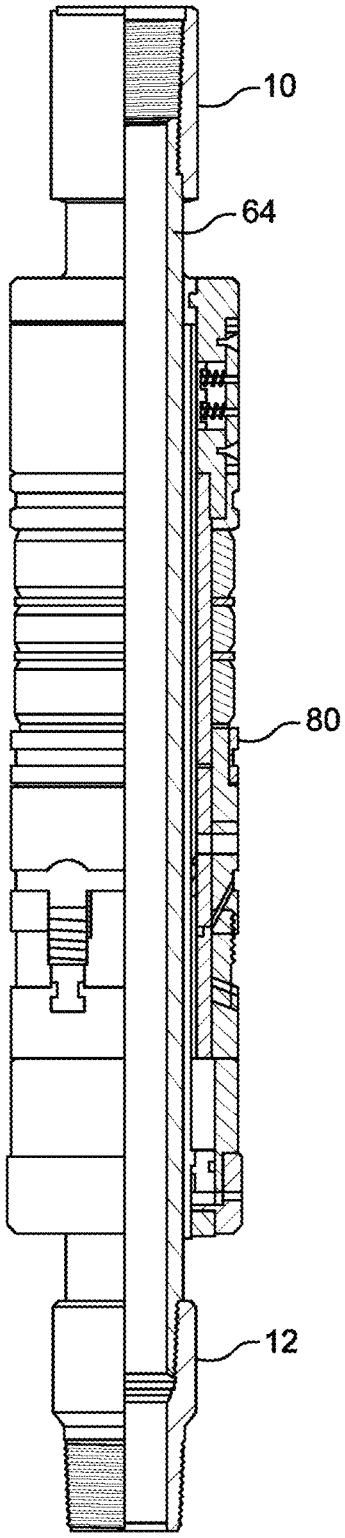
FIG. 11 illustrating a conventional hydraulic/hydrostatic packer of common use.

FIG. 1 illustrates an example upper connection (10) of a conventional packer used in the present state of the art, and FIG. 2 illustrates a lower connection (12) of a conventional packer used in the present state of the art. The present invention comprises an upper adapter (40) and a lower adapter (50), and an inner tube (62) assembled in such a way that the conventional packer (80) (FIG. 11) is able to allow the internal passage of hydraulic control lines and/or electrical signal cables making it possible to command hydraulic equipment positioned below the packer (80) (e.g., sliding sleeve valves (FIG. 15)) or to transmit data sensors (FIG. 13) (e.g., a permanent downhole gauge (PDG) sensor (82), a pressure sensor, and/or a temperature sensor), which are also positioned in the production or injection string (30) below the packer (80).

More precisely, the present invention comprises assembling the upper, lower and inner tube adapters in a conventional packer (FIGS. 10 and 11) in order to turn it into a special packer, a feedthrough packer, for smart completion.

Figure 12:
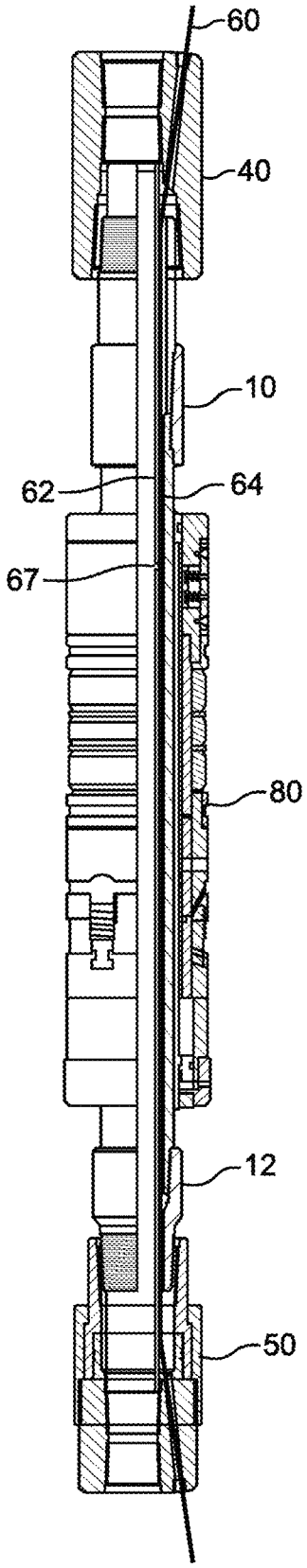
FIG. 12 illustrating the same packer with adapters according to the present invention, for use as a feedthrough packer in smart completion.

The packer (80) adapted to allow the passage one or more cables (60), according to the present invention, comprises the upper adapter (40) (FIG. 8), the lower adapter (50) (FIG. 9), and the inner tube (62) (FIG. 12), wherein the adapters are screwed directly into the original packer connections (FIGS. 1 and 2) and allowing the housing of the inner tube that passes through the conventional packer mandrel, in such a way as to create an annular space in the useful length of the mandrel (64) to allow the passage of a cable (60).

The lower adapter (50) is constructed in such a way that the inner tube (62) is positioned inside the packer mandrel (64) (FIG. 10) eccentrically thereto and allows creating a sufficient annular space for the passage of a cable (60). Such a cable (60) can include electrical or hydraulic lines. In the same way, the upper adapter (40) is also constructed to guarantee the same alignment of the inner tube (62) and maintaining the annular space and the passage of the electrical or cables (60).

Figure 3:
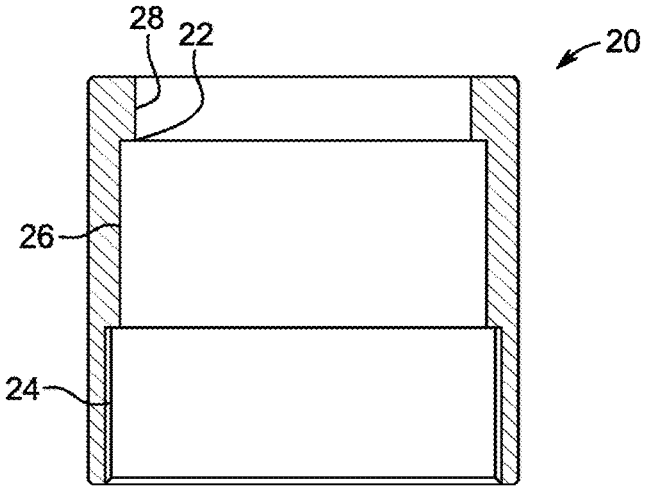
FIG. 3 illustrating the rotating element of the lower adapter according to the present invention.
Figure 4:
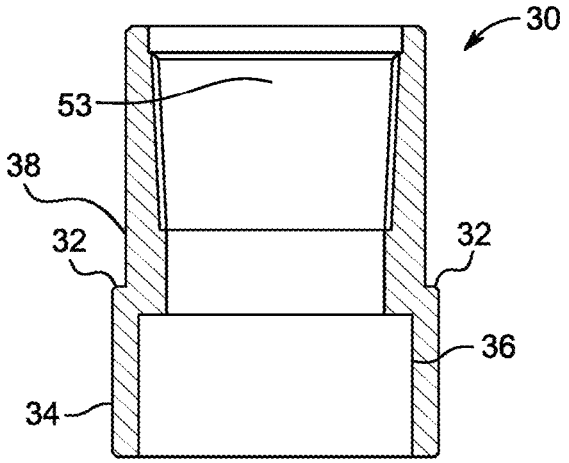
FIG. 4 illustrating the threaded element, fixed to the lower adapter string according to the present invention.
Figure 5:
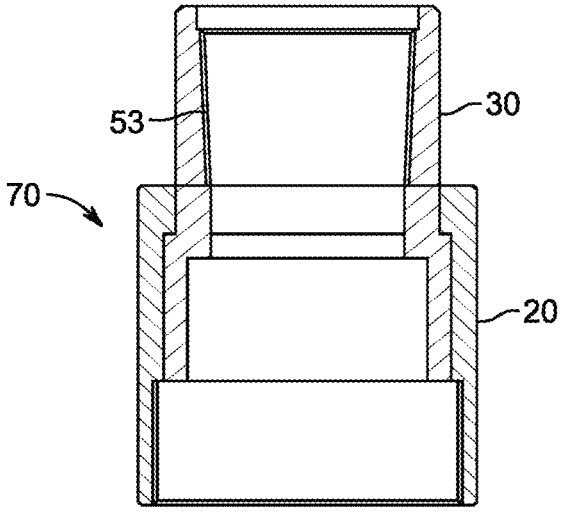
FIG. 5 illustrating the assembly of the rotating element and the threaded element to form part of the lower adapter of the packer according to the present invention.
Figure 6:
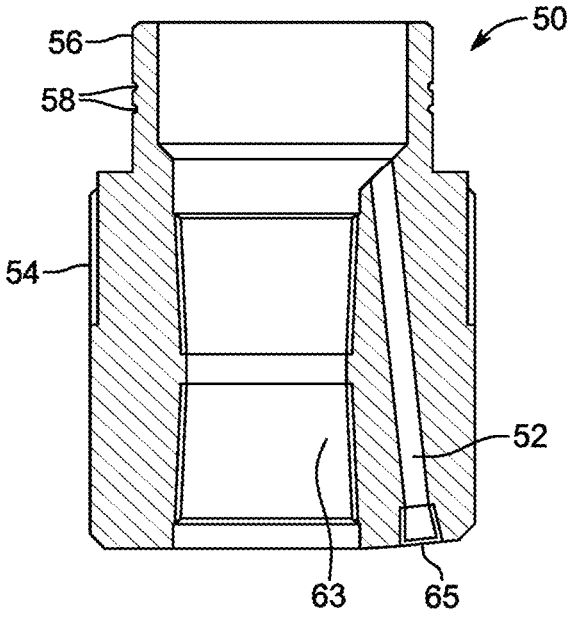
FIG. 6 illustrating the element of the lower adapter fixed to the packer according to the present invention.
Figure 7:
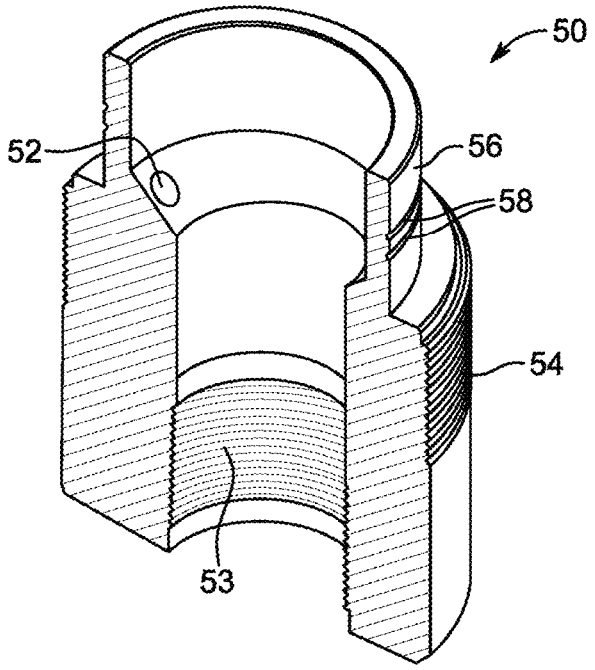
FIG. 7 illustrating a perspective view of the lower adapter element fixed to the packer according to the present invention.
Figure 9:
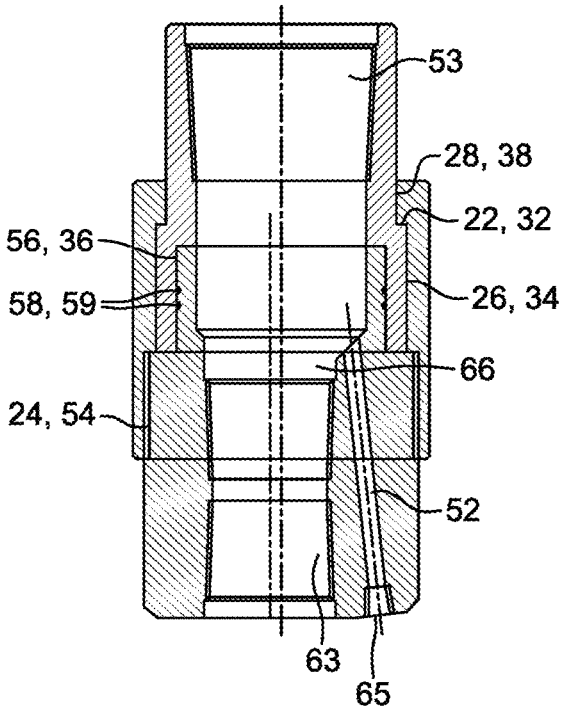
FIG. 9 illustrating the assembly comprising the lower adapter with the fixed and rotating elements of the packer according to the present invention.

The lower adapter (50), according to the present invention, further comprises a rotating adapter (70) (FIG. 5) consisting of a first rotating element (20) and a second element fixed to the production or injection string (30) (FIGS. 3, 4, and 5). Its assembly, along with the thread (53) of the lower adapter (50) of FIG. 6, is shown in FIG. 9.

As can be seen in FIG. 3, the rotating element (20) comprises a first internal diameter (24) provided with threading; a second internal diameter (26) provided with a sealing inner surface that is slightly smaller than the first internal diameter (24); a third inner diameter (28) that is smaller than the second internal diameter (26); wherein this difference in diameters between the second and third diameters forms a step (22) orthogonal to the diameters (26) and (28).

As can be seen in FIG. 4, the element fixed to the string (30) comprises a thread (53), a first external diameter (34), and a second outside diameter (38) that is smaller than the first outside diameter (34); wherein this difference in diameters between the first and second diameters forms a step (32) orthogonal to the diameters (34) and (38). Additionally, said element fixed to the string (30) comprises a first internal diameter (36).

Figure 8:
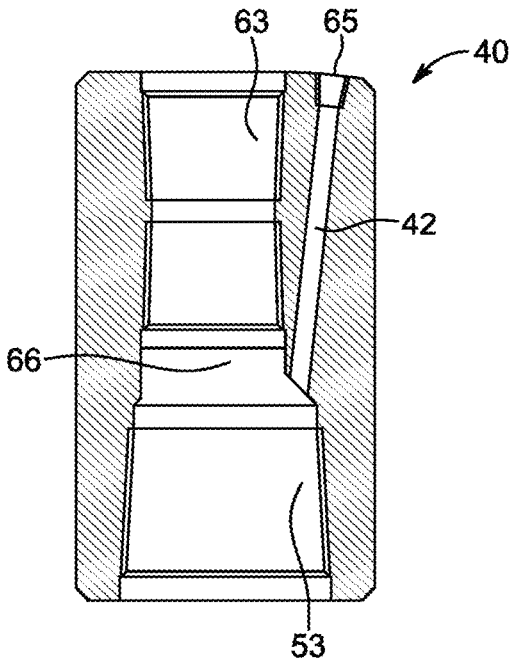
FIG. 8 illustrating the upper adapter of the packer according to the present invention.

FIG. 8 illustrates the upper adapter (40) of the packer (80) with the passage of the hydraulic or electrical line (42) with the threads for the string (63) and for the mandrel (64) of the packer (80) and for the thread (53) connecting the hydraulic line (65). Internally, the housing of the inner tube (62) in the upper adapter (66) is shown.

FIG. 9 illustrates the assembly of the rotating elements (20) and fixed to the production or injection string (30) in the lower adapter (50), in which the coupling is snugly carried out between fixed elements of the production or injection string (30) and lower adapter (50) to the rotating element (20), so that the outer diameter (56) of the lower adapter (50) fits snugly into the internal diameter (36) of the element fixed to the production or injection string (30). This coupling is sealed by means of O-rings (59).

Figure 10:
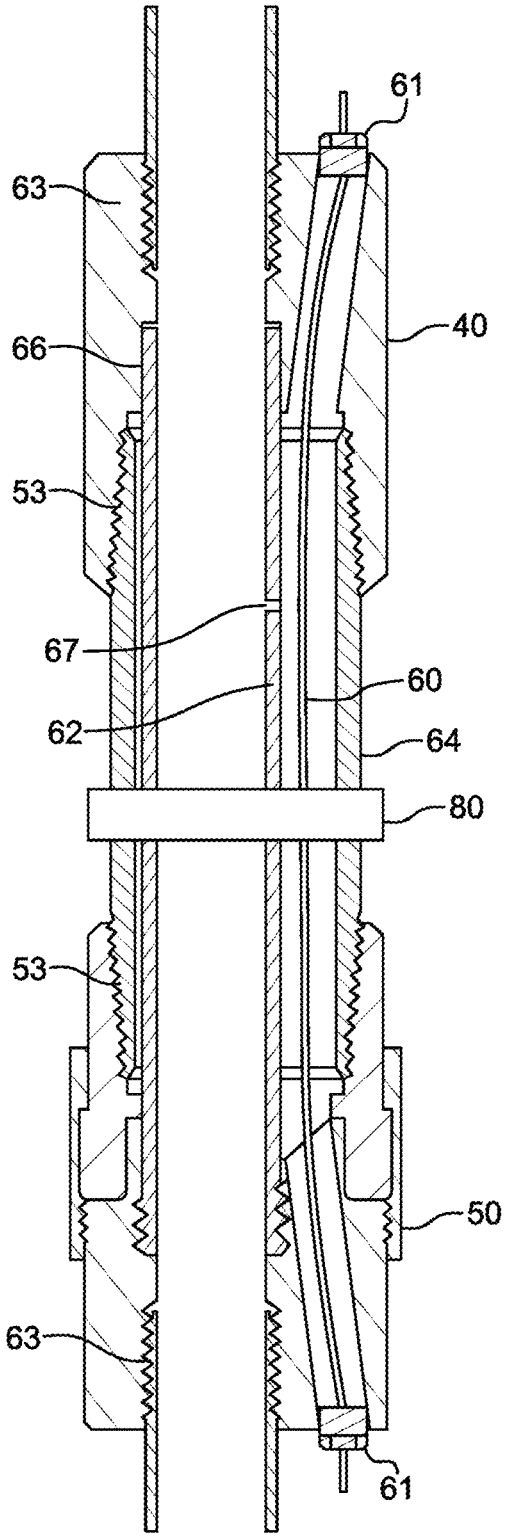
FIG. 10 illustrating the packer mandrel using the upper and lower adapters threaded thereon according to the present invention.

FIG. 10 illustrates the lower adapter (50) threaded by its thread (53) at the respective lower end of the packer (80), wherein the inner tube (62) having a smaller diameter than the inner diameter of the mandrel (64) of the packer (80) is installed internally in such a way as to create an annular space to allow the passage of a cable (60). This inner tube (62) does not create a seal at the ends and has a hole (67) to ensure communication between the string fluid and the drive mechanism of the packer (80). Next, the upper adapter (40) is assembled so as not to receive the final tightening, and the cable (60) or a hydraulic line is then passed through the mandrel (64) of the packer (80). After this assembly, the final tightening is carried out without the possibility of twisting the cable (60), and next the sealing rings (61) are fixed at the ends of the cable (60).

Figure 13:
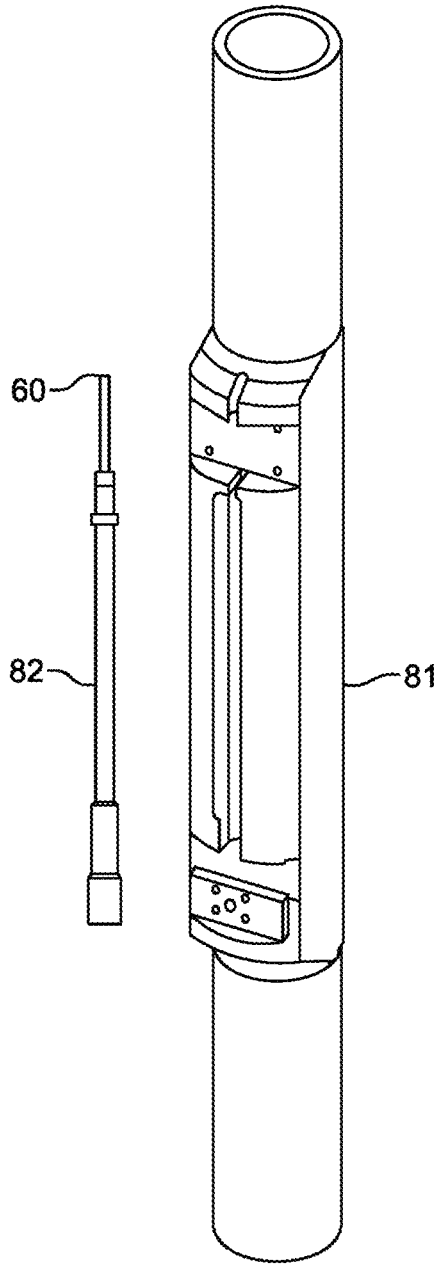
FIG. 13 illustrating a schematic of the PDG housing mandrel with the PDG sensor installed.
Figure 14:
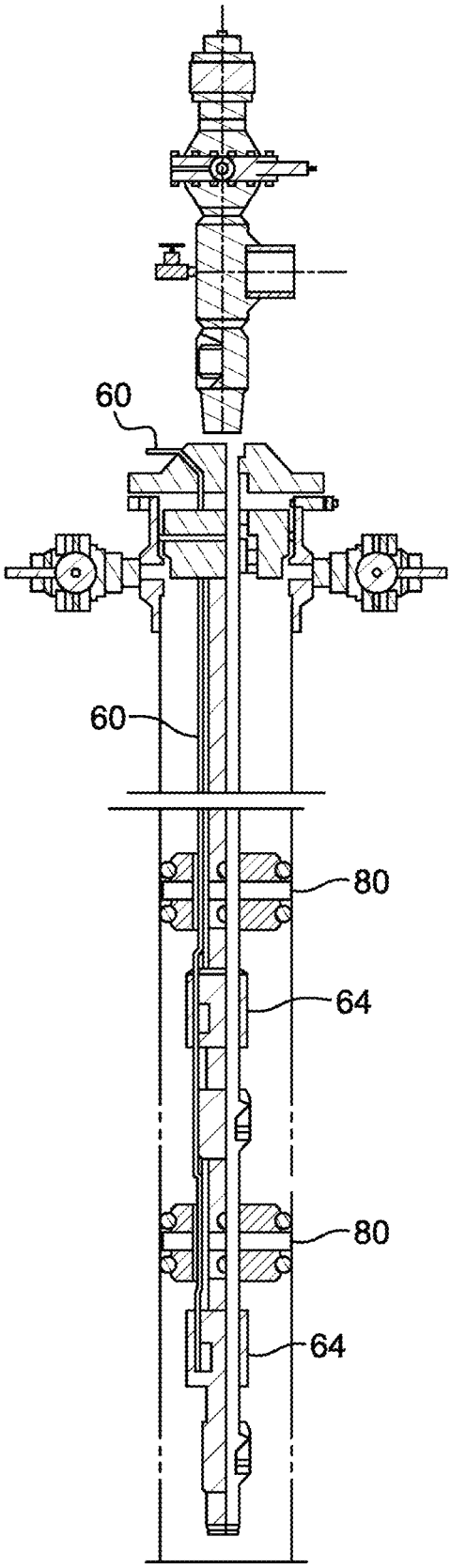
FIG. 14 illustrating a drawing of a well string in smart completion, showing the positioning of the PDG mandrel and the packers with the passage of the PDG cable.

FIG. 13 shows a schematic of the PDG housing mandrel (81) with the PDG sensor (82) installed.

Figure 15:
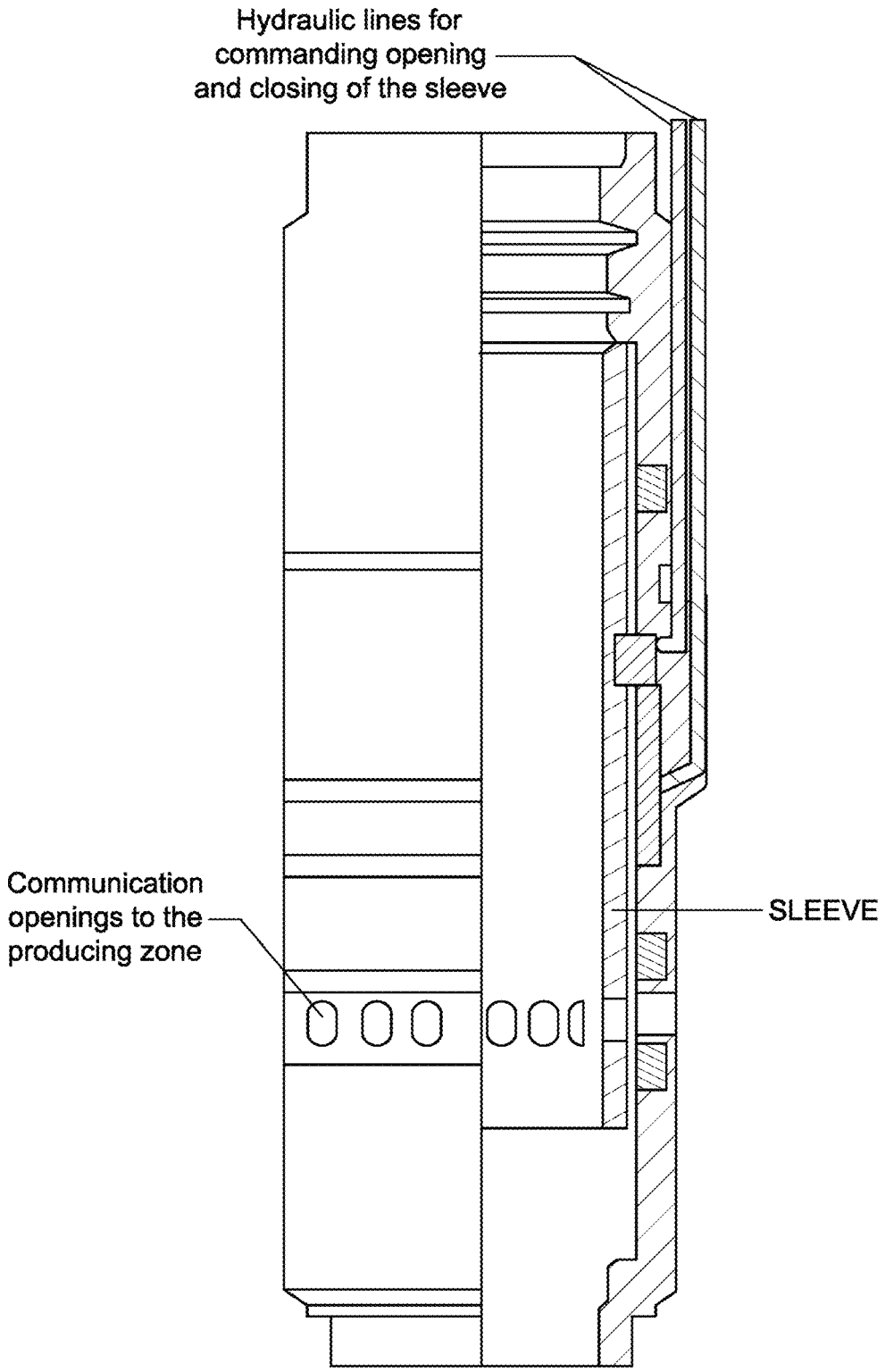
FIG. 15 illustrating a sliding sleeve valve from the state of the art.

FIG. 15 shows a sliding sleeve valve, an item included in the state of the art, hydraulically operated for opening and closing (sliding sleeve), used in the production or injection string to establish communication between the interior and exterior of the string.

Once the assembly of the packer (80) according to the present invention is completed, the hydrostatic tests are carried out on the set to check for possible leaks, by plugging one of the ends and pressurizing the other-end, and observing the limit of the seating pressure of the packer (80). Passing the tests, the packer (80) according to the present invention is ready for use.

It should be noted that, although the present invention has been described in relation to the attached drawings, the assembly can be used in other equipment that have threaded mandrels and that require internal passages as an alternative to the external passage, either by impossibility (presence of packers) or external diameter limitations (string anchor, etc.). This invention may undergo modifications and adaptations by technicians skilled on the subject, depending on the specific situation, but provided that it is within the inventive scope defined herein.

The invention claimed is:

1. A bottomhole packer comprising:

an upper adapter fixed and screwed to a mandrel of a packer the upper adapter defining a passage eccentric from a central axis of the upper adapter;

a lower rotating adapter attached to the mandrel of the packer; and an inner tube sized for a length of the packer and an internal diameter of a production or injection string, the mandrel surrounding the inner tube, the inner tube and the mandrel defining an annular passage between the inner tube and the mandrel through which control lines or cables internally pass from a downhole sensor, commanding hydraulic equipment or transmitting data from the downhole sensor installed in the production or injection string that are positioned below the packer.

2. The bottomhole packer according to claim 1, wherein the upper adapter is threaded into the mandrel of the packer, an inner diameter of the mandrel of the packer defines an inner tube with a diameter smaller than the inner diameter of the mandrel, defining the annular space for the passage of the control lines or cables, with sealing by ring connections threaded into a threaded port of the upper adapter.

3. The bottomhole packer according to claim 1, wherein the lower rotating adapter comprises an element with a first external diameter that is threaded and a second external diameter comprising two grooves on its perimeter for insertion of O-rings and a fixed connection to the production or injection string, with a rotating element attached to the element fixed to the mandrel of the packer for ease of assembly without damaging electrical or hydraulic lines.

4. The bottomhole packer according to claim 1, wherein the lower adapter and the upper adapters are configured to receive the control lines or cables, inside the mandrel of the packer, of the inner tube with a diameter smaller than the inner diameter of the mandrel creating an annular space for the passage of the control lines or cables according to internal housings in each of the upper adapter and the lower rotating adapter.

5. The bottomhole packer according to claim 1, wherein the hydraulic equipment comprises a sliding sleeve valve.

* * * * *